US007114622B2

(12) United States Patent
Miranda et al.

(10) Patent No.: US 7,114,622 B2
(45) Date of Patent: Oct. 3, 2006

(54) MODULAR GOLF CLUB DISPLAY

(75) Inventors: Walter R. Miranda, Hawthorn Woods, IL (US); Mark F. Stanton, Chicago, IL (US); Rodrigo R. Dienstmann, Chicago, IL (US); Steven G. Dietrich, Elmhurst, IL (US); Fred G. Geiger, Glenview, IL (US); Jeffrey C. Ouyang, Chicago, IL (US); Mayur Patadia, Chicago, IL (US); Jerry J. Zablocki, Des Plaines, IL (US)

(73) Assignee: Cormark, Inc., Des Plaines, IL (US)

( * ) Notice: Subject to any disclaimer, the term of this patent is extended or adjusted under 35 U.S.C. 154(b) by 198 days.

(21) Appl. No.: 10/821,086

(22) Filed: Apr. 8, 2004

(65) Prior Publication Data

US 2005/0045571 A1 Mar. 3, 2005

Related U.S. Application Data

(60) Provisional application No. 60/497,969, filed on Aug. 26, 2003.

(51) Int. Cl.
*A63B 55/00* (2006.01)

(52) U.S. Cl. ..... 211/70.2; 211/60.1; 206/315.2; 473/282

(58) Field of Classification Search ..... 211/70.2; 206/315.2, 315.4, 315.6; 473/282
See application file for complete search history.

(56) References Cited

U.S. PATENT DOCUMENTS

| | | | | |
|---|---|---|---|---|
| 4,086,678 | A * | 5/1978 | Torr | 15/105 |
| 6,085,901 | A * | 7/2000 | Lin | 206/315.6 |
| D483,427 | S * | 12/2003 | Lim | D21/796 |
| 2004/0140281 | A1 * | 7/2004 | Kutzke | 211/87.01 |

* cited by examiner

*Primary Examiner*—Richard E. Chilcot, Jr.
*Assistant Examiner*—Jared W. Newton
(74) *Attorney, Agent, or Firm*—Welsh & Katz, Ltd.

(57) ABSTRACT

A display for supporting and displaying golf clubs is configured to support the golf clubs by their heads such that the club shaft is oriented downwardly. The display includes a support member and at least one cradle mounted to the support member. The cradle has first and second upwardly curving arcuate support arms separated from one another by a trough. Each of the support arms defines an uppermost portion with the trough between the support arms. The cradle is configured such that the support arms uppermost portions are non-linear relative to one another through the trough. The golf club is positioned in the cradle resting one the support arms and with the shaft extending downwardly from about the trough.

20 Claims, 7 Drawing Sheets

MODULAR GOLF CLUB DISPLAY

The present application claims the benefit of the filing date of U.S. Provisional Application Ser. No. 60/497,969, filed 26 Aug. 2003.

BACKGROUND OF THE INVENTION

The present invention is directed to a display for golf clubs. More particularly, the present invention is directed to a modular golf club display that cradles a golf club at its head to support the club, and can support a plurality of such clubs in a consistent direction and orientation.

Many different types of golf club displays are known. These displays range from a simple wall or surface against which the clubs' grips (the handle end of the club) are leaned, to displays that support the clubs in an upside-down orientation for viewing the base of the head.

Head supporting type displays (i.e., displays in which the club is supported upside-down for readily viewing the base of the head) are advantageous in that a consumer can quickly determine the type of club (e.g., a wood or a titanium driver), the club number (e.g., a 1-wood, 3-wood, 5-wood), and ordinarily, the club manufacturer. Moreover, in a typical display of this type, the clubs are securely held and as such there is less likelihood that the clubs will fall.

One known type of head supporting display includes an elongated slot in which a plurality of clubs are inserted. In such a display, however, it can be difficult to get to the first such inserted club if the slot is too narrow to merely pull the club upward. That is, if the grip is larger than the slot (and the club cannot be pulled upward), the subsequently inserted or displayed clubs must be removed to get to an earlier inserted or displayed club. As such, consumers may be more inclined to merely lay aside the clubs rather than putting the clubs back into the display.

In those instances where the slots are sufficiently large to permit the grip to be pulled through, the slots may be so large that the clubs "roll" around in the display. This can result in a sloppy and disorganized club display.

Other known head support type displays include smaller slots for individual clubs. Such slots can include a frictional material (e.g., rubber) insert to provide increased hold for the clubs. However, like the larger-lost type noted above, in such displays, the clubs often "roll" resulting in a sloppy and chaotic display of clubs. Moreover, the rubber (or other resilient material) can break or become damaged which can render the display non-functional.

Accordingly, there exists a need for an improved head support type golf club display. Desirably, such a display supports the clubs in a neat and organized manner. More desirably, the display is modular in that the individual club supporting elements can be readily replaced or changed with minimal effort.

BRIEF SUMMARY OF THE INVENTION

A display for supporting and displaying golf clubs supports the head of a golf club such that the shaft is oriented downwardly. The display supports the clubs in a neat and organized manner with the downwardly oriented shafts straight and parallel to one another. Such a display is modular in that the individual club supporting elements can be readily replaced or changed with minimal effort, and can support both left-handed and right-handed clubs.

The display includes a support member, such as a support arm and at least one (and preferably multiple) cradles mounted to the display support arm. The cradle has first and second upwardly curving arcuate club support arms separated from one another by a trough. Each of the arms defines an uppermost portion with the trough between the support arms. The cradle is configured such that the support arm uppermost portions are non-linear relative to one another through the trough. In a present cradle, an angle between the uppermost portions (at the trough) is formed between about 90 degrees and about 120 degrees.

The club is positioned in the cradle resting against the support arms and with the shaft extending downwardly from about the trough. In a preferred display, the cradle is reversible and is formed having mirror image first and second support arms and a mirror image trough on an opposing side of the cradle. This permits use of a single cradle (design) for supporting both right-handed clubs and left-handed clubs. In one display the cradle is movable about the support member for switching the cradle from the right-handed club support to the left-handed club support.

In a preferred cradle, a peak is defined between the first and second upwardly curving arcuate support arms in the trough (at a rear corner of the cradle) such that when a club is positioned in the cradle, the club rests on the peak and against the support arms. In this manner, gravity assists in orienting the club shaft straight downwardly.

In a present cradle the arms are formed as a plurality of ribs extending from a spine. The ribs are formed generally transverse to the spine. An arm supporting portion of the cradle includes a bore and the display support member includes a rod received in the bore. In this arrangement, the cradle is pivotable about the rod for pivoting the rod between the left-handed club supporting position and the right-handed club supporting position.

In an arrangement in which the support member is configured for receiving a plurality of cradles mounted thereto in alignment with one another, each of the cradles is pivotable about the rod independent of each other cradle.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying figures, wherein.

DETAILED DESCRIPTION OF THE INVENTION

Figure 1:
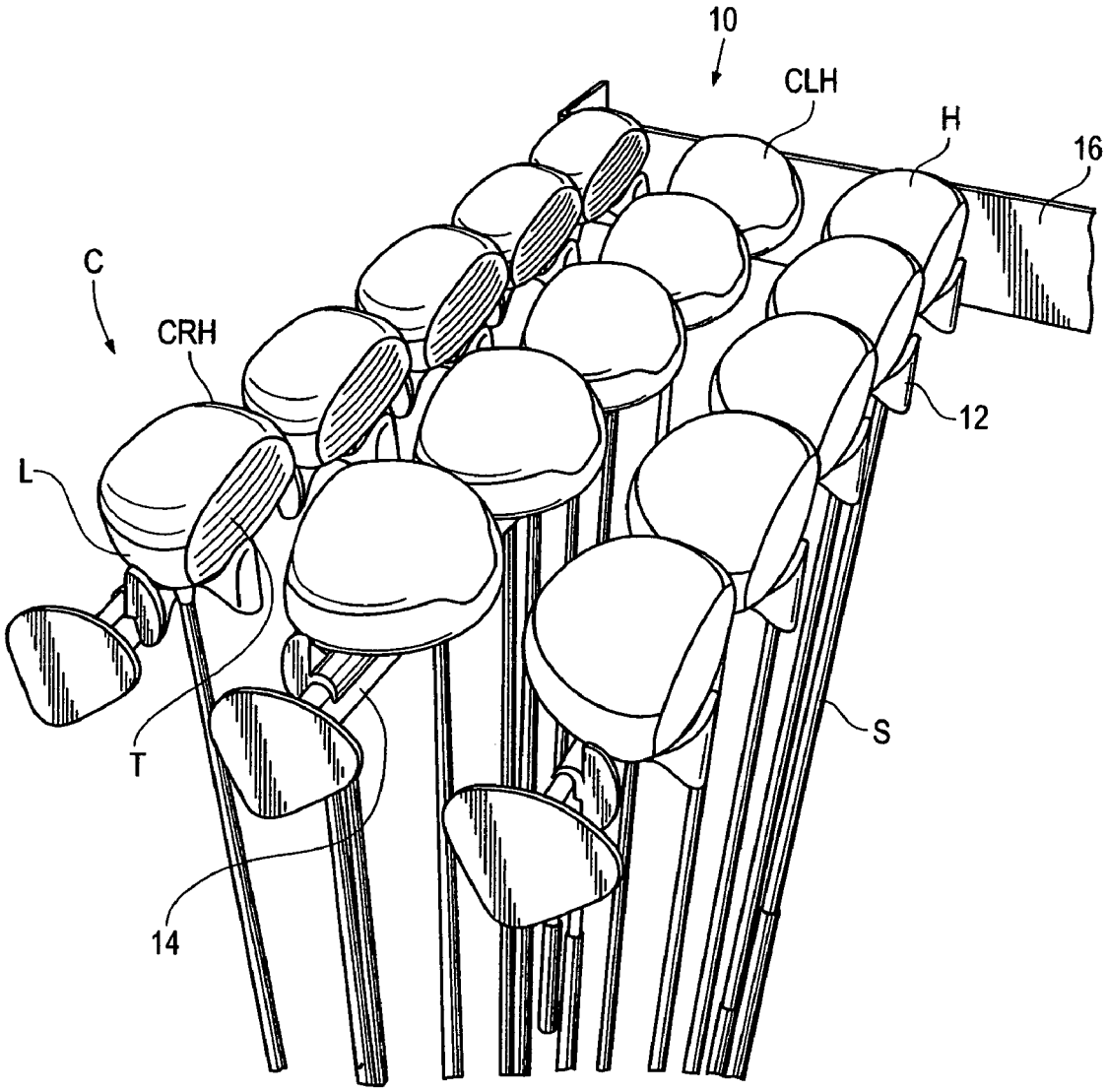
FIG. 1 is a perspective view of a modular golf club display, in accordance with the principles of the present invention, the display shown with opposingly facing cradles and clubs supported thereby.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown a modular golf club display 10 embodying the principles of the present invention. The display 10 is shown with a plurality of clubs C supported by the display 10 in an opposing or facing manner. The display 10 includes, generally, a plurality of cradles 12, one or more support arms 14 and a support bracket or stand 16. An array of cradles 12 is associated with each arm 14.

As seen in FIGS. 2–5, in one embodiment, each cradle 12 includes a cradling portion, indicated generally at 18, and a support arm attachment region 20. The cradle 12 defines a rear corner 22 having arms 24, 26 extending therefrom. The arms 24, 26 terminate at upwardly curving arcuate surfaces 28, 30 that essentially define two peaks 32, 34 with a trough or valley 36 between the peaks 32, 34. Viewed another way, the shape is akin to a skewed or bent saddle shape. That is, the peaks 32, 34 and trough 36 are oriented or positioned such that a line through them (i.e., a peak 32-trough 36-peak 34 line, as indicated at $A_{12}$) is not a straight line. Rather, the peaks 32, 34 are at an angle $\alpha$ relative to one another through the trough 36. In a present cradle 12, the angle $\alpha$ between the peaks 32, 34 through the trough 36, when viewed from above the cradle 12, is about 90 degrees to about 120 degrees; other angles will, of course, function well. When viewed in terms of a solid object, the cradle is formed as the outer surface of about ⅛ of a sphere, with a central portion (as indicated at 38) of the surface removed.

The cradle 12 is configured so that the shaft S of a club C is positioned in the removed portion 38 of the surface (e.g., a circumferential notch) such that the upwardly arcuately extending surfaces 28, 30 cup the top of the club head H. In this manner, a capture region 40 is defined by the cradle 12 and the club C is securely held in the cradle capture region 40 with the "top" of the head H (that is, that portion of the head H at the head H/shaft S juncture) residing in the trough 36 and the depending or lower portions of the head H resting on the surfaces 28, 30 that extend from the trough 36 to the peaks 32, 34. It is also seen from FIG. 1, that the striking surface T of the club C is positioned against one of the surfaces 28 while the heel L of the club C is positioned against the other surface 30. With the club C so positioned in the cradle 12, it is readily removed from the cradle 12 by slightly lifting the club C to pass the head H over the peaks 32, 34.

Figure 2:
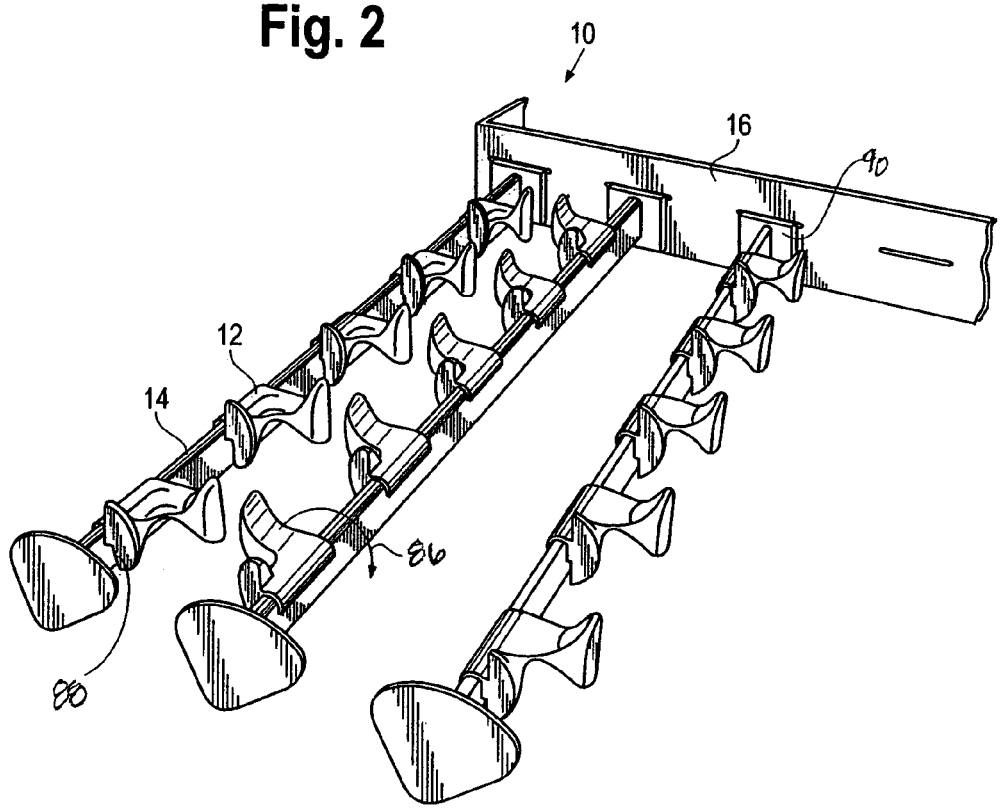
FIG. 2 is a perspective view of the display of FIG. 1 with the golf clubs removed for clarity of viewing.
Figure 3:
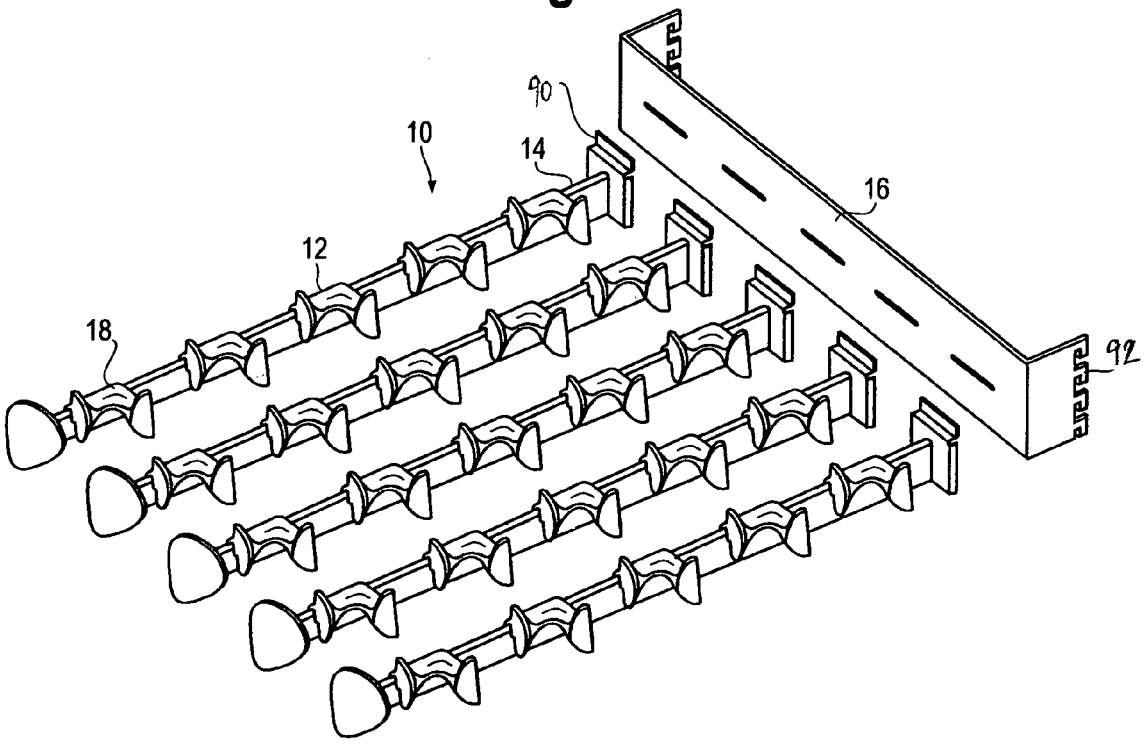
FIG. 3 is a perspective view of the display shown with the cradles facing in the same direction, and showing one exemplary manner in which the cradle support arm can be secured to a fixture.
Figure 4:
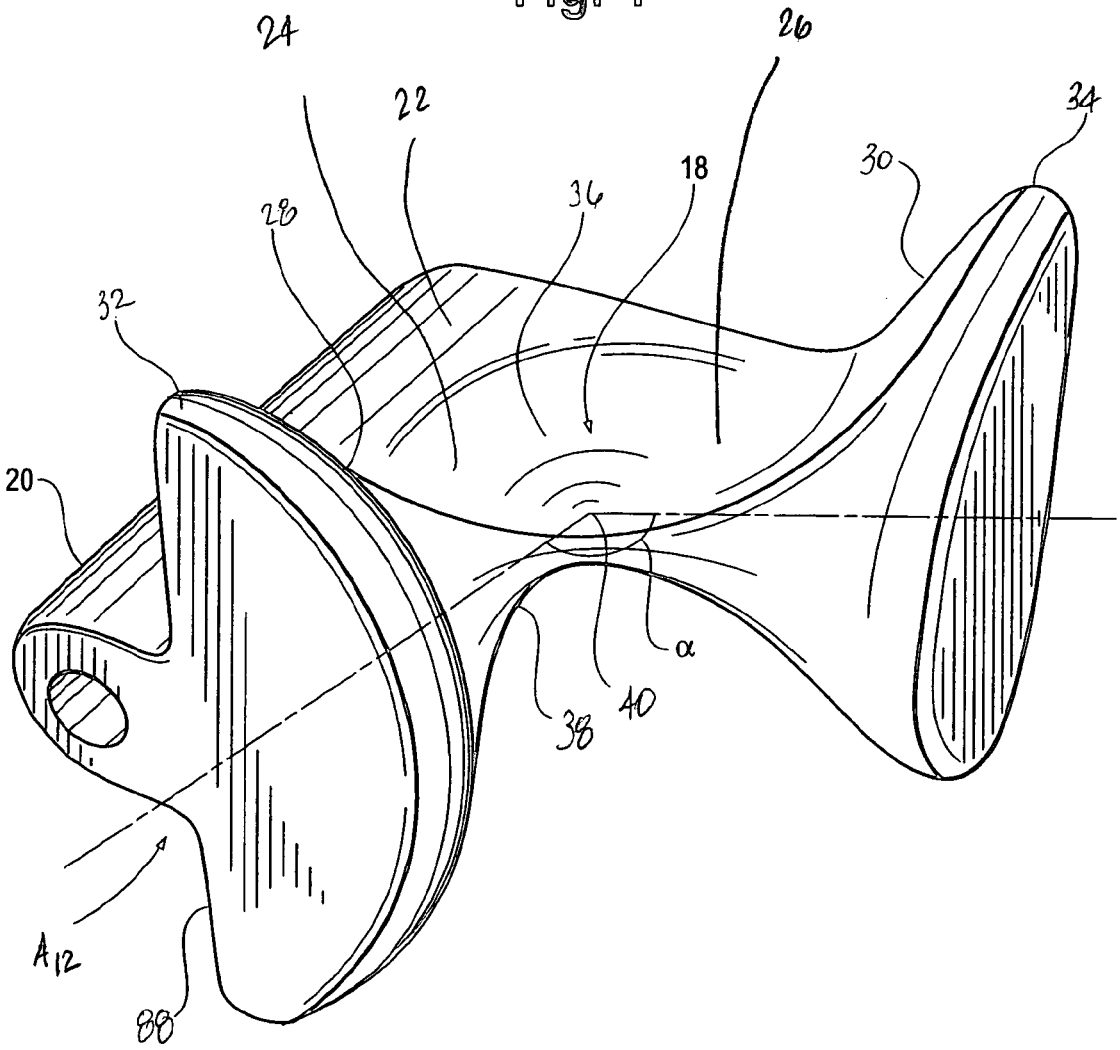
FIG. 4 is a perspective view of one of the cradles as seen from the cradle entry.
Figure 5:
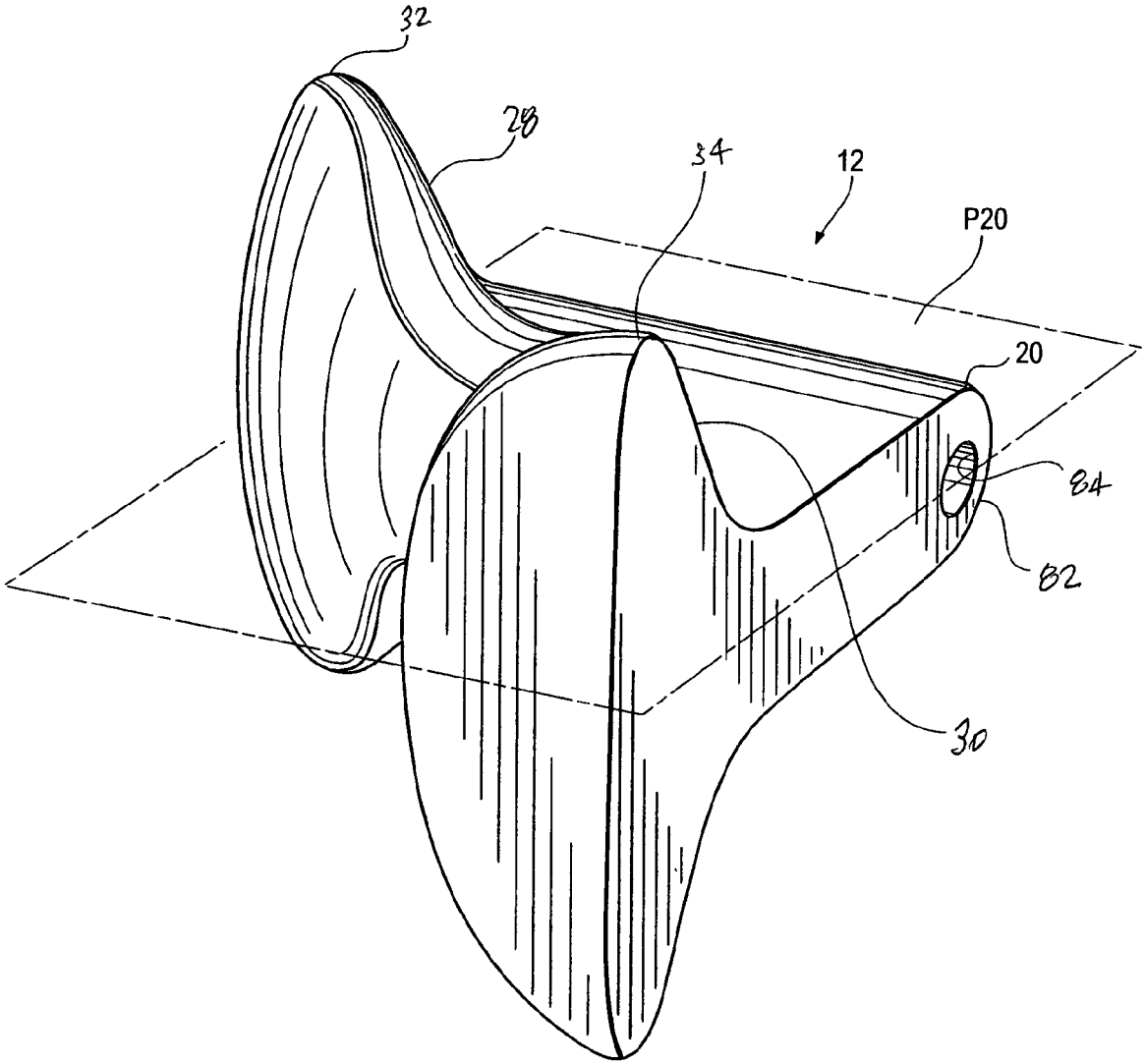
FIG. 5 is a perspective view of the cradle as seen from the rear of the cradle.
Figure 6:
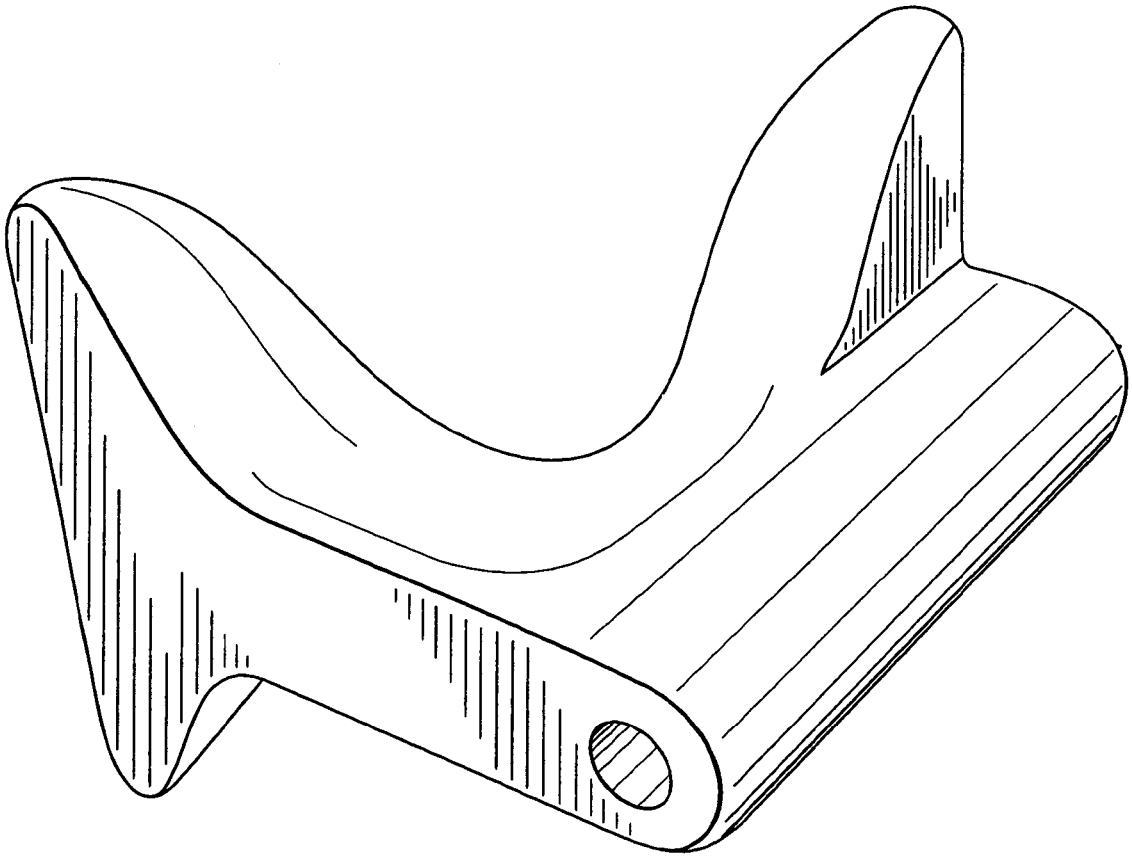
FIG. 6 is another rear perspective view of the cradle.

As will be understood from FIGS. 1 and 2, the cradle 12 can be configured to support both right-handed clubs $C_{RH}$ and left-handed clubs $C_{LH}$. A preferred cradle 12 is formed as a reversible support element having a mirror image shape on an opposing side (as shown in the figures, the underside). In such a configuration, the "mirror image" is defined relative to a plane $P_{20}$ through the support arm attachment region 20. In this manner, only a single cradle need be fabricated to support both left- and right-hand clubs.

Figure 7:
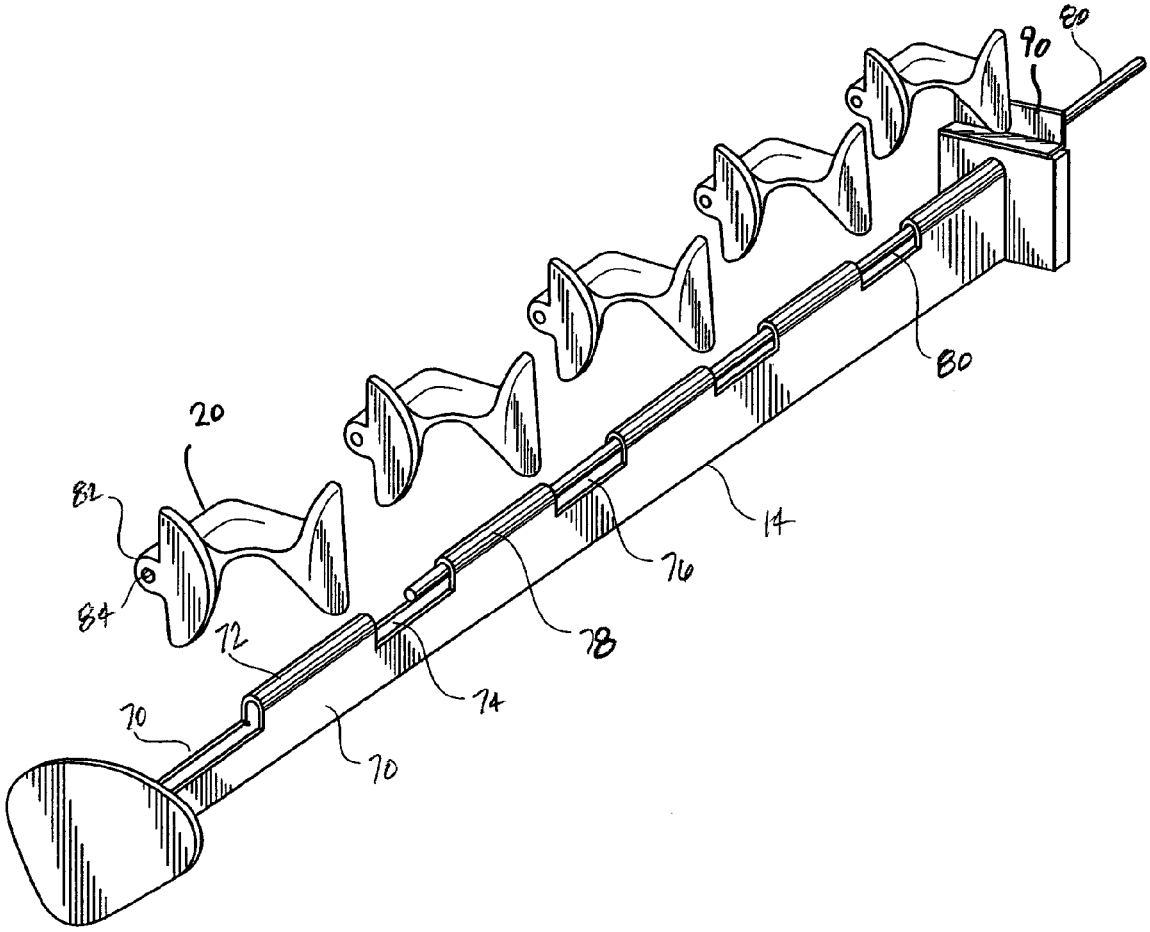
FIG. 7 is an exploded view of the cradles and the cradle support arm
Figure 8:
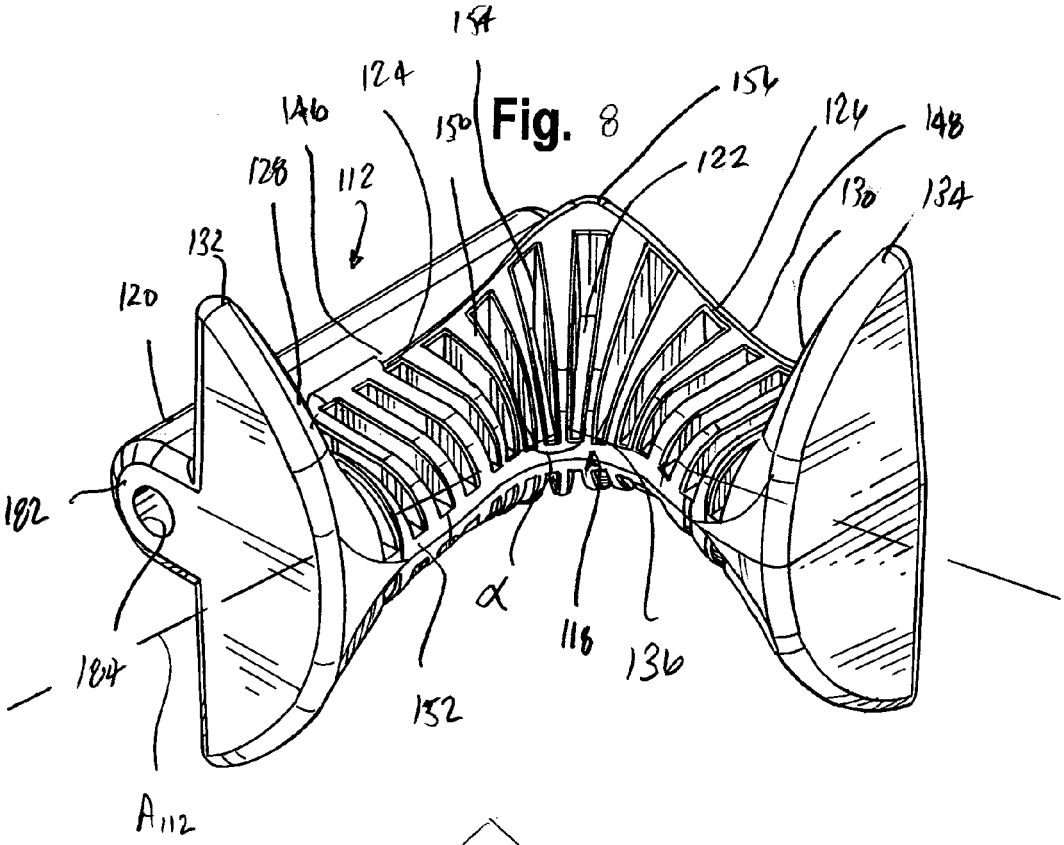
FIG. 8 is a front perspective view of an alternate embodiment of the cradle, looking into the center of the cradle.
Figure 9:
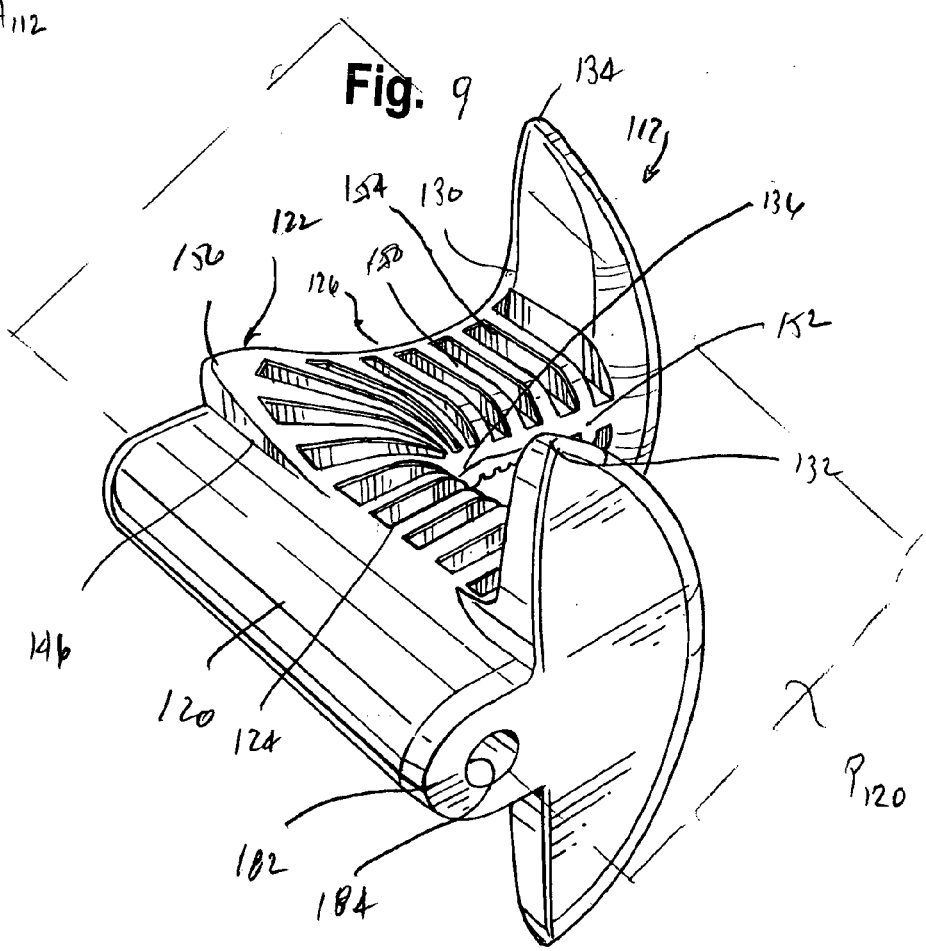
FIG. 9 is a side perspective view of the cradle of FIG. 8.

An alternate embodiment of the cradle 112 is shown in FIGS. 8–9. This embodiment is similar to that of FIGS. 1–7, having a skewed or bent saddle shape and including a cradling portion, indicated generally at 118, defined by first and second upwardly curving arcuate surfaces 128, 130 that form two peaks 132, 134 with a trough or valley 136 between the peaks 132, 134. The cradle 112 includes a support arm attachment region 120. The peaks 132, 134 and trough 136 are oriented or positioned such that a line (i.e., the peak 132-trough 136-peak 134 line, as indicated at $A_{112}$) is not straight. Rather, the peaks 132, 134 are at an angle $\alpha$ relative to one another through the trough 136. In a present cradle 112, the angle $\alpha$ between the peaks 132, 134 through the trough 136, when viewed from above the cradle 112, is about 90 degrees to about 120 degrees; other angles will, of course, function well.

In this embodiment of the cradle 112, the arms 124, 126 are formed having rear walls 146, 148, with the surfaces 128, 130 of the arms 124, 126 being formed by a plurality of ribs 150 upstanding from a central spine 152. The central spine 152 is formed perpendicular to the rear walls 146, 148 of the arms 124, 126 (in the case of the arm 124, perpendicular to the support arm attachment region 120), with the ribs 150 extending upwardly and downwardly from the spine 152. In this manner, the ribs 150 define slots 154 between adjacent ribs 150. It has been found that this arrangement provides the necessary structural integrity or support for holding the clubs, with sufficient rigidity to retain the overall shape of the cradle 112. At the same time, the ribbed 150 configuration combines cost savings in that less material is used (the slots 154 between the ribs 150 are devoid of material), and ease of manufacture in that, for example, known injection molding techniques can be used. Of course, other manufacturing methods may also be used to make either embodiment of the cradle 12, 112.

Those skilled in the art will recognize that golf clubs are not all alike. That is the shape or profile of the top surface of a club head H is likely to be different from any or each other club. This is particularly true among different manufacturers and even among different clubs of each manufacturer. It was found that, in certain instances, when a club C was resting in the cradle with the top of the club head H resting on the arms, the club may not sit straight in the cradle such that the shaft of the club hung straight down. It is believed that this was due to the friction developed at the juncture of the club head and the arms.

To this end, referring to FIGS. 8 and 9, it can be seen that the rear corner 122 of the cradle 112 is elevated relative to the arms 124, 126 between the rear corner 122 and the peaks 132, 134. That is, the arms surfaces 128, 130 curve downwardly (or dip) between the corner 122 and the peaks 132, 134. This configuration defines a point, as indicated at 156, at the rear corner 122, rather than resting surfaces, on which the club head H rests. In this arrangement, the club head H essentially rests on a point contact 156 (at the rear corner 122) and against the peaks 132, 134.

It was found that this rear point 156 contact, rather than surface contact of the head H, permits the club shaft S to "hang" with the shaft S oriented straight or nearly straight down. This has increased aesthetic appeal in that multiple club shafts S in the display all hang straight down (and parallel to one another), rather than each being askew and appearing to hang in a disorganized and sloppy manner.

Referring to FIG. 7, the present display 10 includes a unique arrangement for attaching the cradles 12, 112 to the support arm 14. The support arm 14 is formed as a pair of spaced apart depending legs 70 having an arcuate or rolled upper portion 72. Along the upper portion 72, sections (as indicated at 74) are removed such that a series of windows 76 and discrete connecting sections 78 are formed. The legs 70 are spaced from one another (or, viewed another way, the arcuate or rolled portion 72 is formed having a diameter of) a predetermined distance or size. A rod 80 is configured for insertion between the legs 70 at the upper connecting portion 78. As seen in FIG. 7, the rod 80 shows through the windows 76 (or spaces) in the arm 14.

Alternately, although not shown, the arm can be formed having a single depending flange with a tubular sleeve extending along an upper end of the flange. Such a sleeve is formed as a series of discrete sleeve sections spaced from one another along the flange and having an inner diameter, that is configured for receiving the rod.

The support arm attachment region 20, 120 of each cradle 12, 112 is formed as a central fin 82, 182 having a bore 84, 184 extending therethrough. As set forth above, the plane $P_{20}$, $P_{120}$ through the attachment region 20, 120 also bisects the fin 82, 182 and bore 84, 184, and establishes the mirror image reference plane of the cradle 12, 112. The bore 84, 184 in the fin 82, 182 has a diameter that is about the same the distance between the support arm legs 70. In this manner, as seen in FIG. 8, the cradles 12, 112 are positioned in the support arm windows 76 (or between the sleeve portions) and the rod 80 is inserted through the arm 14 and the bore 84, 184 of each cradle 12, 112 to secure the individual cradles 12, 112 to the support arm 14.

Advantageously, the cradle 12, 112 and arm 14 are configured so that to change the cradle 12, 112 from a right-handed club $C_{RH}$ support to a left-handed club $C_{LH}$ support (or vice-versa), the cradle 12, 112 is merely pivoted about the rod 80 (as indicated generally by the arrow at 86 in FIG. 2), to the opposing side of the arm 14. As such, any configuration of all right- or left-handed or a combination of right- and left-handed cradles 12, 112 (and clubs C) can be accommodated in the display 10. As seen in FIG. 2, the rear of the opposing (i.e., the lower or non-used) peak defining surface forms a stop 88 that rests against the support arm 14 to prevent over-pivoting of the cradle 12, 112 and to maintain the position of the cradle 12, 112 so that it properly supports the club C in an upright orientation.

Any number of configurations can be used to secure the support arm 14 to, for example, a fixture. In the illustrated embodiment, the arm 14 is shown mounted to the bracket 16 by an L-shaped flange 90. The flange 90 is configured for insertion into the bracket 16 so that multiple arms 14 can be affixed to a single bracket 16. The bracket 16 can be mounted to a wall, a rack or any other structural member (not shown), by, for example, the hook arrangement 92 illustrated.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the disclosed, exemplary embodiments.

What is claimed is:

1. A display for supporting and displaying golf clubs, the display comprising:
- a support member;
- a cradle;
- the cradle comprising two arms;
- the two arms being separated from one another by a first trough on a first side of the cradle;
- the two arms being separated from one another by a second trough on a second side of the cradle;
- the cradle being movable between a first orientation and a second orientation relative to the support member;
- the cradle configured for supporting and displaying a golf club, with a shaft of the golf club extending downwardly from the cradle, and with a head of the golf club resting against the first side of the cradle when the cradle is in the first orientation and against the second side of the cradle when the cradle is in the second orientation;
- a first one of the two arms comprising a first uppermost portion on said first side of the cradle;
- a second one of the two arms comprising a second uppermost portion on said first side of the cradle;
- the first trough comprising a lowermost portion;
- a first projection being a projection on a horizontal plane of straight line through the first uppermost portion and the lowermost portion;
- a second projection being a projection on the horizontal plane of a straight line through the second uppermost portion and the lowermost portion;
- wherein said first and second projections intersect at an angle greater than 0° and less than 180°.

2. The display as in claim 1, the two arms being mirror images of each other.

3. The display as in claim 1, the first and second sides of the cradle being mirror images of each other.

4. The display as in claim 1,
- the first side of the cradle being configured for supporting a right-handed golf club;
- the second side of the cradle being configured for supporting a left-handed golf club.

5. The display as in claim 1, at least one of the first and second sides of the cradle further comprising an intermediate peak between the two arms.

6. The display as in claim 1, at least one of the two arms comprising a plurality of ribs extending from a spine.

7. The display as in claim 6, the ribs being generally transverse to the spine.

8. The display as in claim 1,
- the support member comprising a rod;
- the rod being received through a bore in the cradle;
- the cradle being pivotable about the rod for switching between the first and second orientations.

9. The display as in claim 1, the display further comprising:
- a plurality of cradles;
- each of the plurality of cradles being mounted to the support member.

10. The display as in claim 9,
- the support member comprising a rod;
- each of the plurality of cradles being mounted to the rod.

11. The display as in claim 10, each of the plurality of cradles being pivotable about the rod independent of the other cradles of the plurality of cradles.

12. The display as in claim 1, the two arms being curved on each of the first and second sides on the cradle.

13. The display as in claim 1, the first and second projections intersecting at an angle between about 90° and about 120°.

14. The display as in claim 1, the display further comprising:

a bracket;

the support member being mounted on the bracket;

the bracket mountable on a structural member.

15. The display as in claim 14, the display further comprising:

a plurality of support members;

each of the plurality of support members being mounted on the bracket.

16. A display for supporting and displaying golf clubs, the display comprising:

a support member;

a cradle;

the cradle comprising two arms;

the two arms being separated from one another by a first trough on a first side of the cradle;

the two arms being separated from one another by a second trough on a second side of the cradle;

the cradle being movable between a first orientation and a second orientation relative to the support member;

the cradle configured for supporting and displaying a golf club, with a shaft of the golf club extending downwardly from the cradle, and with a head of the golf club resting against the first side of the cradle when the cradle is in the first orientation and against the second side of the cradle when the cradle is in the second orientation;

the cradle being pivotable about the support member for switching between the first and second orientations;

a first one of the two arms comprising a first stopping surface on the first side of the cradle for inhibiting over-rotation of the cradle about the support member when the cradle is in the second orientation;

the first one of the two arms comprising a second stopping surface on the second side of the cradle for inhibiting over-rotation of the cradle about the support member when the cradle is in the first orientation.

17. The display as in claim 16, the first and second sides of the cradle being mirror images of each other.

18. The display as in claim 16, at least one of the first and second sides of the cradle further comprising an intermediate peak between the two arms.

19. The display as in claim 16, at least one of the two arms comprising a plurality of ribs extending from a spine.

20. The display as in claim 16, the display further comprising:

a plurality of cradles;

each of the plurality of cradles being pivotable about the support member independent of the other cradles of the plurality of cradles.

* * * * *